US012467458B2

(12) United States Patent
Batdorff et al.

(10) Patent No.: US 12,467,458 B2
(45) Date of Patent: Nov. 11, 2025

(54) VARIABLE CAPACITY BYPASS VALVE FOR SCREW COMPRESSOR

(71) Applicant: HITACHI GLOBAL AIR POWER US, LLC, Michigan City, IN (US)

(72) Inventors: Jonathan D. Batdorff, Fort Wayne, IN (US); Hideki Fujimoto, Shizuoka (JP); Edward Noble, Chesterton, IN (US)

(73) Assignee: HITACHI GLOBAL AIR POWER US, LLC, Michigan City, IN (US)

( * ) Notice: Subject to any disclaimer, the term of this patent is extended or adjusted under 35 U.S.C. 154(b) by 0 days.

(21) Appl. No.: 18/727,307

(22) PCT Filed: Jan. 20, 2022

(86) PCT No.: PCT/US2022/013169
§ 371 (c)(1),
(2) Date: Jul. 8, 2024

(87) PCT Pub. No.: WO2023/140851
PCT Pub. Date: Jul. 27, 2023

(65) Prior Publication Data

US 2025/0084845 A1 Mar. 13, 2025

(51) Int. Cl.
*F04C 28/26* (2006.01)
*F04C 18/16* (2006.01)

(52) U.S. Cl.
CPC ..... *F04C 28/265* (2013.01); *F04C 18/16* (2013.01)

(58) Field of Classification Search
CPC ..... F04C 28/265; F04C 18/16
See application file for complete search history.

(56) References Cited

U.S. PATENT DOCUMENTS 4,579,513 A 4/1986 Zimmern et al.
4,946,362 A * 8/1990 Soderlund ..... F04C 29/0035 418/270

(Continued)

FOREIGN PATENT DOCUMENTS

JP 2003-3976 A 1/2003
JP 2012-77720 A 4/2012

OTHER PUBLICATIONS

International Search Report and Written Opinion Issued in Priority PCT/US2022/013169, dated Jul. 27, 2023, 8 pages.

(Continued)

*Primary Examiner* — Jesse S Bogue
(74) *Attorney, Agent, or Firm* — PROCOPIO, CORY, HARGREAVES & SAVITCH LLP

(57) ABSTRACT

A screw compressor and a variable capacity bypass valve therefor are provided. The variable capacity bypass valve includes a bore formed in a rotor bore discharge face of the compressor housing upstream of a compression chamber outlet end of the compression chamber, a slide valve member inserted into the bore to fill a cavity, the valve member having a sealing surface configured to interact with a thread of a compressor screw during operation of the screw compressor, an actuator structure coupled to the valve member and oriented to move the valve member radially along the bore to open a fluid pathway communicatively coupling the compressor chamber to a bypass chamber configured to return compressed fluid to a fluid inlet of the compression chamber.

13 Claims, 12 Drawing Sheets

(56) References Cited

U.S. PATENT DOCUMENTS

| | | | | |
|---|---|---|---|---|
| 5,108,269 | A * | 4/1992 | Glanvall | F04C 28/16 417/310 |
| 5,556,271 | A * | 9/1996 | Zuercher | F16K 27/029 251/63 |
| 6,461,119 | B1 * | 10/2002 | Timuska | F04C 28/16 417/418 |
| 10,954,943 | B2 * | 3/2021 | Akei | F04C 29/12 |
| 11,365,736 | B2 * | 6/2022 | Bi | F04C 28/265 |
| 11,397,034 | B2 * | 7/2022 | Schwoeppe | F25B 41/20 |
| 12,221,963 | B2 * | 2/2025 | Batdorff | F04C 28/16 |
| 2003/0223897 | A1 | 12/2003 | Ferentinos | |
| 2011/0038747 | A1 * | 2/2011 | Shoulders | F04C 28/16 137/855 |
| 2016/0265533 | A1 * | 9/2016 | Pullins | F04C 28/26 |

OTHER PUBLICATIONS

Office Action issued in relared JP Patent Application No. 2024-541836, dated May 20, 2025, 7 pages.
Extended European Search Report issued in related patent application EP22922440.7, mailed Jun. 30, 2025, 7 pages.

* cited by examiner

VARIABLE CAPACITY BYPASS VALVE FOR SCREW COMPRESSOR

BACKGROUND

Field

The present disclosure relates to screw compressor and in particular a screw compressor having a variable capacity bypass valve.

Related Art

Screw gas compressors may be known in the related art. In the related art, a screw compressor may include a compressor housing and a motor (for example, a permanent magnet rotor/stator motor) is used to drive one (e.g., a first compression screw) of the two compression screws. The second of the two compression screws may be mechanically coupled to the compression screw that is driven by the motor. The second compression screw may thus be driven by the first compression screw. In the related art, gas may be drawn into the compressor through an inlet, compressed between the two compression screws as they turn, and output through an outlet which is downstream of the gas inlet and the compression screws.

In some related art, the gas compressor may include a mechanical capacity control mechanism that provides one or more bypass ports or valve openings formed in the compressor housing or a rotor cowling to allow gas to exit the housing to control or prevent over pressurization or compression along the length of the compression screws. In the related art, the one or more bypass ports or valve openings may be positioned adjacent to a spiral valve that controls the opening and closing of the bypass ports or valve openings by a shutter that is rotated to a point that uncovers bypass ports and allows one or more of the bypass ports to communicate with the bypass chamber changing the compression length of the compressor.

However, in some related art, the efficiency of a spiral valve equipped compressor may be greatly reduced at capacity reduction (turn down) levels higher than 50%. This can be due to the higher pressures developed where the valve is need to operate overcomes the seal formed by the oil in the gap between the spiral valve shutter and the rotor housing window.

Further in some related art, other variable capacity control (VCC) devices, such as poppet or lift valves or axial slide valves may be used, but these devices also experience more leakage at higher pressure, even if there may be a better seal than spiral valves. Further, both lift valves and axial slide valves cost more to manufacture, are difficult to assemble, and are more difficult to maintain.

These difficulties can result from a complex shape of the moving sealing surface and how it coincides with its complex mating surface. Further, lift valve designs can work against rotor design because the rotor apex seal is inherently narrow and lift valves are inherently wide. Further, the valve may bridge across adjacent rotor threads with large pressure differentials, making it difficult for lift valves to precisely control turndown. Example implementations described herein may address these problems.

SUMMARY

Aspects of the present disclosure may include a variable capacity bypass valve for a screw compressor having a compressor housing defining a compression chamber. The variable capacity bypass valve may include a bore formed in a rotor bore discharge face of the compressor housing upstream of the compression chamber outlet end of the compression chamber, a slide valve member inserted into the bore to fill a cavity formed in the rotor bore discharge face of the compressor housing, the valve member having a sealing surface configured to interact with a thread of a compressor screw during operation of the screw compressor, and an actuator structure coupled to the valve member and oriented to move the valve member radially along the bore to open a fluid pathway communicatively coupling the compressor chamber to a bypass chamber configured to return compressed fluid to a fluid inlet of the compression chamber.

Further, aspects of the present disclosure may also include a screw compressor having a compressor housing defining a compression chamber having a compression chamber outlet end and a plurality of bypass ports communicating with the compression chamber, a spiral valve positioned adjacent the plurality of bypass ports communicating with the compression chamber, the spiral valve comprising a shutter configured to selectively open and close one or more of the plurality of bypass ports based on a rotational position, and a variable capacity bypass valve. The variable capacity bypass valve may include a bore formed in a rotor bore discharge face of the compressor housing upstream of the compression chamber outlet end of the compression chamber, a slide valve member inserted into the bore to fill a cavity formed in the rotor bore discharge face of the compressor housing, the valve member having a sealing surface configured to interact with a thread of a compressor screw during operation of the screw compressor, and an actuator structure coupled to the valve member and oriented to move the valve member radially along the bore to open a fluid pathway communicatively coupling the compressor chamber to a bypass chamber housing the spiral valve, the bypass chamber configured to return compressed fluid to a fluid inlet of the compression chamber.

Aspects of the present disclosure may also include the sealing surface being a flat sealing surface extending parallel to the rotor bore discharge face of the compressor housing.

Aspects of the present disclosure may also include the valve member being aligned in the bore such that the sealing surface protrude outward from the rotor bore discharge face into the compression chamber.

Aspects of the present disclosure may also include the valve member having a partial cylindrical shape with an opened region on a side opposite the sealing surface.

Aspects of the present disclosure may also include the sealing surface being a flat sealing surface extending parallel to the rotor bore discharge face of the compressor housing.

Aspects of the present disclosure may also include the valve member being aligned in the bore such that the sealing surface protrude outward from the rotor bore discharge face into the compression chamber.

BRIEF DESCRIPTION OF THE DRAWINGS

A general architecture that implements the various features of the disclosure will now be described with reference to the drawings. The drawings and the associated descriptions are provided to illustrate example implementations of the disclosure and not to limit the scope of the disclosure. Throughout the drawings, reference numbers are reused to indicate correspondence between referenced elements.

DETAILED DESCRIPTION

Figure 1:
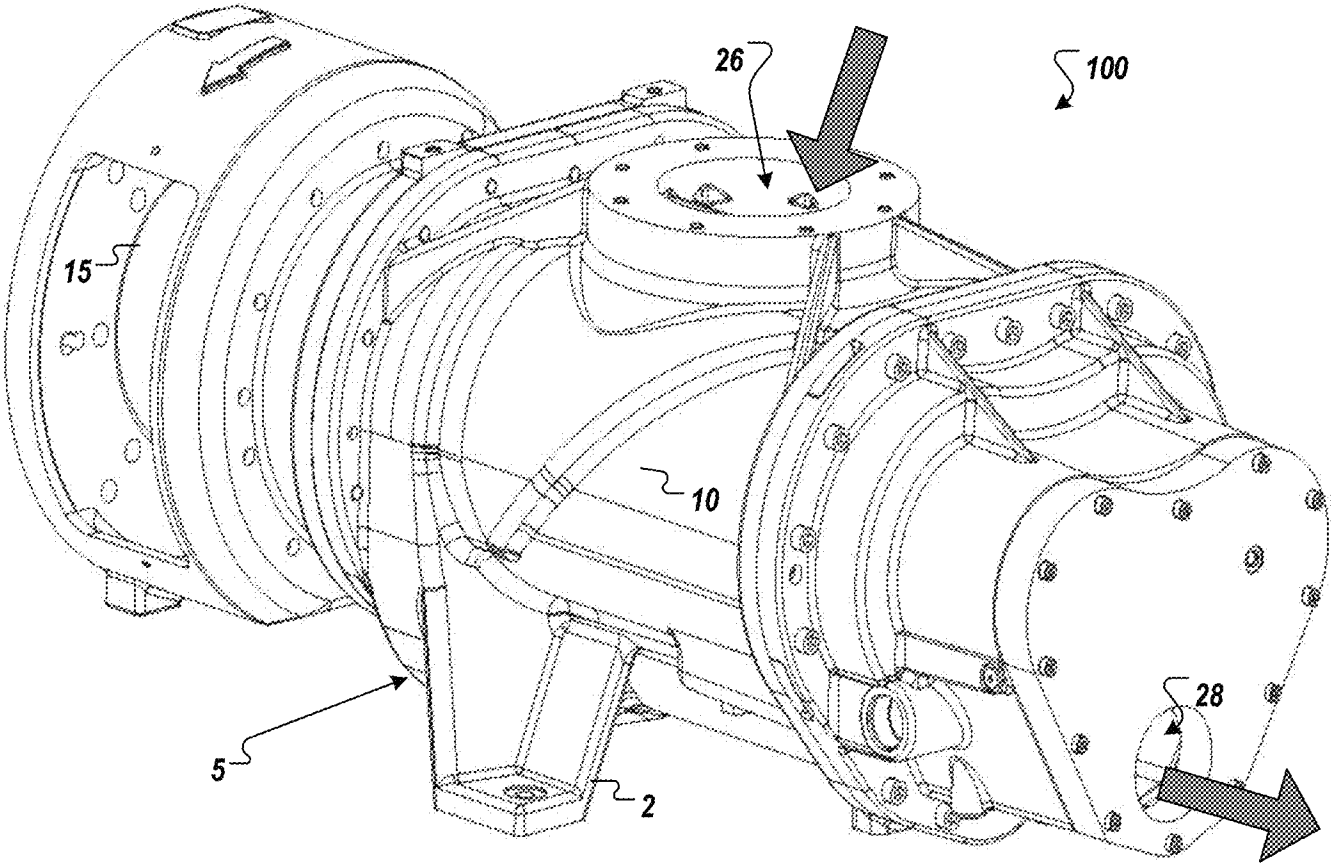
FIG. 1 illustrates a perspective view of a screw compressor having a spiral valve structure and Variable Capacity Bypass Valve in accordance with example implementations of the present application.

The following detailed description provides further details of the figures and example implementations of the present disclosure. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or operator control over certain aspects of the implementation, depending on the desired implementation of one of ordinary skill in the art practicing implementations of the present disclosure. Further, sequential terminology, such as "first", "second", "third", etc., may be used in the description and claims simply for labeling purposes and should not be limited to referring to described actions or items occurring in the described sequence. Actions or items may be ordered into a different sequence or may be performed in parallel or dynamically, without departing from the scope of the present disclosure.

As explained above, in some related art, a gas compressor may include a mechanical capacity control mechanism that provides one or more bypass ports or valve openings formed in the compressor housing or a rotor cowling to allow gas to exit the housing to control or prevent over pressurization or compression along the length of the compression screws. These one or more bypass ports or valve openings may be positioned adjacent to a spiral valve that controls the opening and closing of the bypass ports or valve openings by a shutter that is rotated to a point that uncovers bypass ports and allows one or more of the bypass ports to communicate with the bypass chamber changing the compression length of the compressor. However, the efficiency of a spiral valve equipped compressor can be greatly reduced at capacity reduction (turndown) levels higher than 50% due to the higher pressures developed where the valve is need to operate overcomes the seal formed by the oil in the gap between the spiral valve shutter and the rotor housing window.

To address these problems, example implementations may provide a Variable Capacity Bypass Valve (VCBV) in conjunction with a spiral valve or other VCC devices as a turn down extender. Alternative, the VCBV device shown in the example implementations of the present application could also be used as a standalone capacity control system.

In some example implementations, the VCBV may be a cylindrically shaped valve peripherally located in the rotor housing discharge face so that as it is moved outward, it opens a passage back to the inlet. As described below, the VCBV may be applied to the male, female, or both rotor bore faces and could be actuated with a pneumatic cylinder, hydraulic cylinder, electronic solenoid, or other similar actuator. In the example implementations, using a single valve may provide a cost benefit while using multiple valves may provide more turndown and/or better performance. Because the valve is located peripherally in the rotor housing, it utilizes space not normally used for bearings or other compressor components and is does not occupy the usual path required for the discharge gas.

Figure 2:
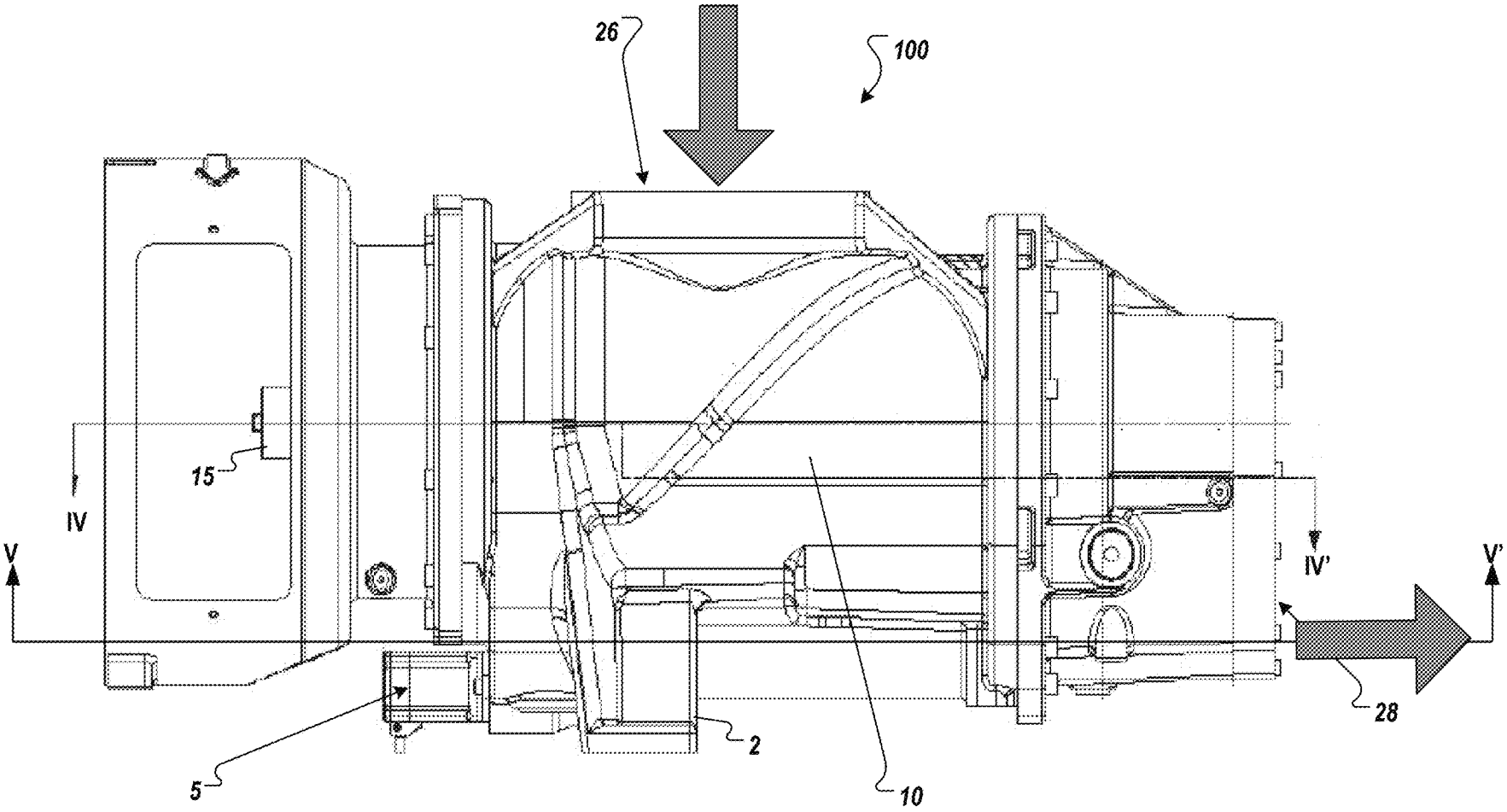
FIGS. 2-3 respectively illustrate side, and top views of the screw compressor in accordance with example implementations of the present application.
Figure 3:
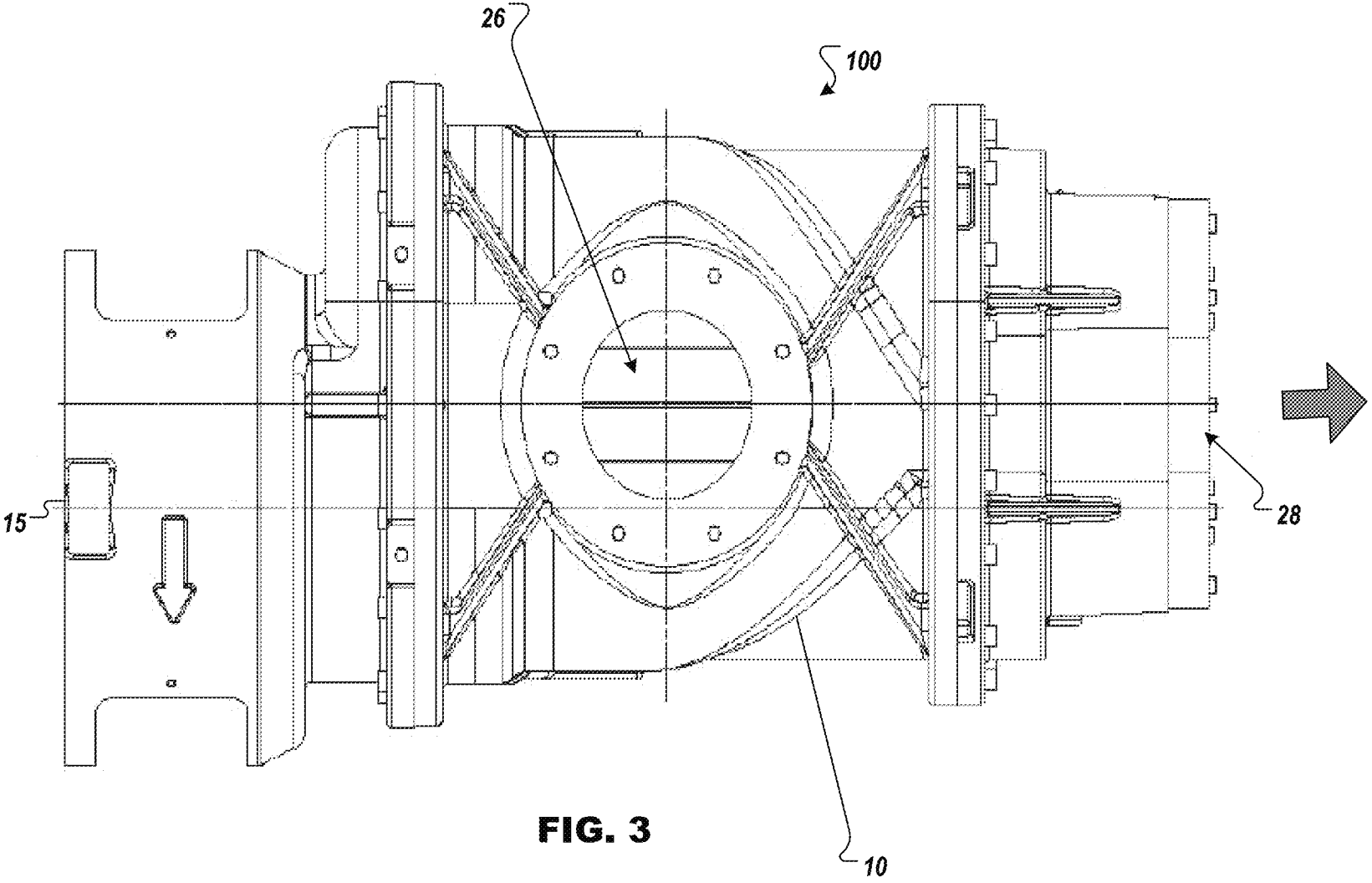

FIG. 1 illustrates a perspective view of a screw compressor 100 having a spiral valve structure and variable Capacity Bypass Valve in accordance with example implementations of the present application. Further, FIGS. 2-3 respectively illustrate side, and and top views of the screw compressor 100 in accordance with example implementations of the present application. As illustrated, the screw compressor 100 includes a compressor housing 10 that surrounds the compressor inner structure and forms a compression chamber 3 (not shown in FIGS. 1-3, illustrated in FIGS. 4-8). The housing 10 may include one or more mounting brackets or feet 2 that support the screw compressor 100 and allow the screw compressor 100 to be secured to a floor or other support platform. For example, the feet 2 may allow the screw compressor 100 to be mounted on a portable support platform or trailer.

The housing 10 also defines a main gas flow inlet 26, and a main gas flow discharge outlet 28. Arrows are provided to illustrate gas flow through the screw compressor 100. Additionally, the compressor housing 10 may allow a drive shaft 15 to pass from the compressor inner structure (illustrated in FIGS. 4-8) to the area surrounding the compressor 100.

The drive shaft 15 may be used to mechanically couple the screw compressor 100 to a motor or engine to drive the screw compressor 100. The screw compressor 100 may be driven by an IC Engine, such as a gasoline engine, a diesel engine, or any other type of engine that might be apparent to a person of ordinary skill in the art. The screw compressor 100 may also be driven by an electric motor, or any type of machine that supplies rotary motive power that might be apparent to a person of ordinary skill in the art.

Further, an actuator module 5 may be attached to the compressor housing 10 and control a spiral valve structure (shown in FIGS. 4-8) located within the compressor housing 10. The actuator module 5 may include an electric motor coupled to a gearbox that is coupled to the spiral valve. Additionally, the actuator module 5 may also include an integrated processor component that may include onboard control logic that controls the actuator module 5 automatically, semi-automatically based partially on a user input or manually based entirely on a user input. One or more separate actuator modules may also be used to control a Variable Capacity Bypass Valve (VCBV) as shown in FIGS. 5-8, 9A-9D, and 10A-10B.

Figure 4:
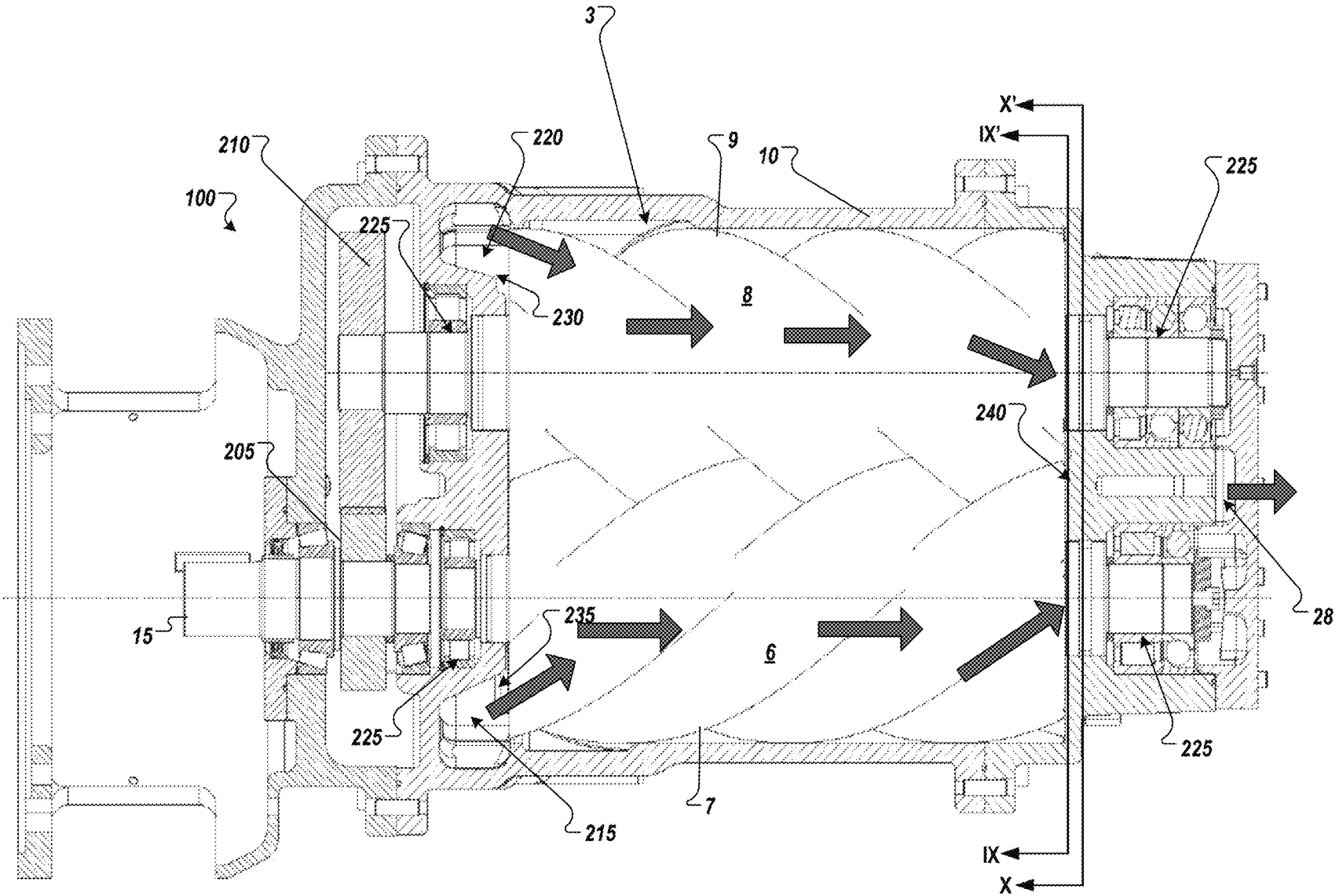
FIGS. 4 and 5 illustrate sectional views of the screw compressor taken along line IV-IV' and line V-V' of FIG. 3, respectively.
Figure 5:
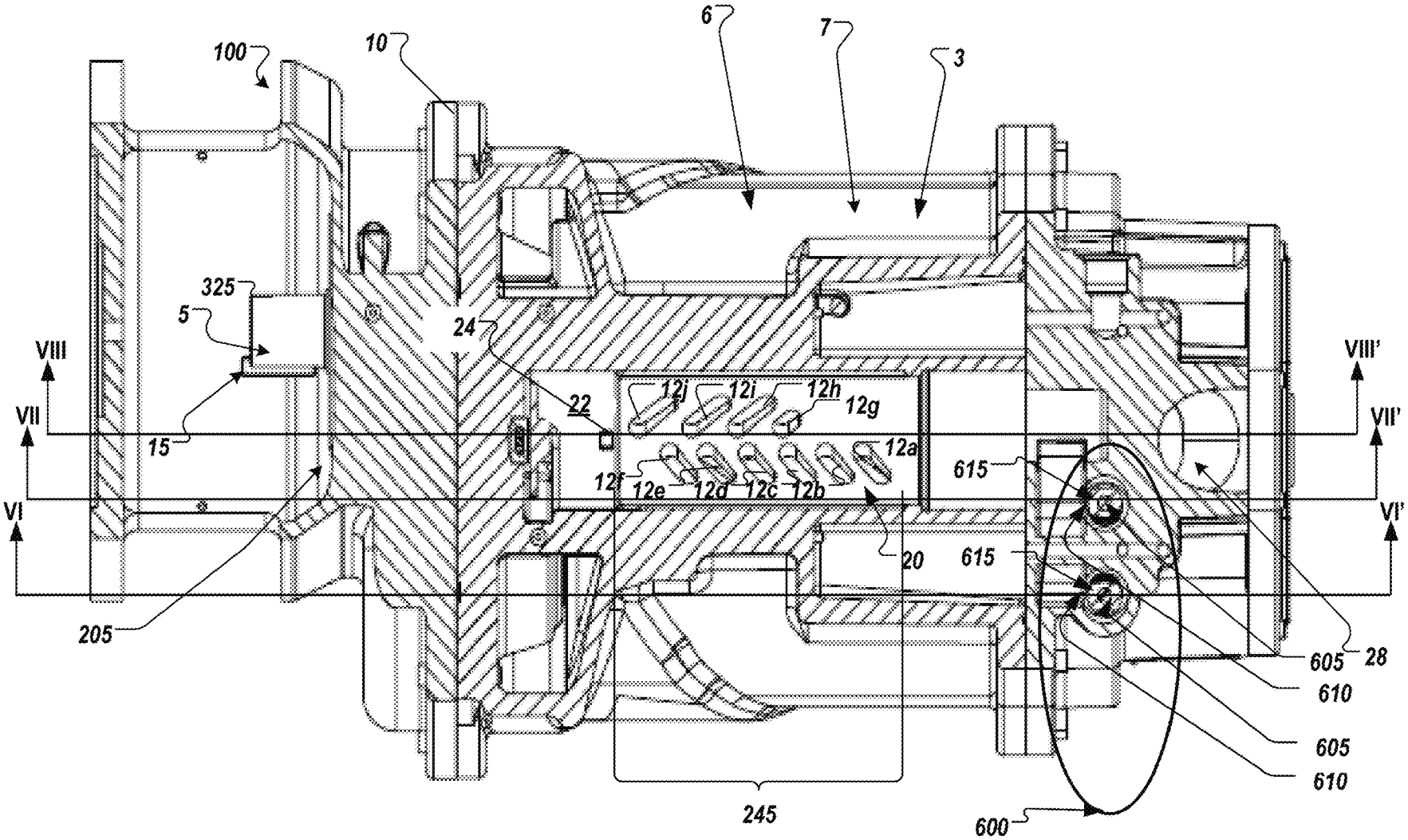
Figure 6:
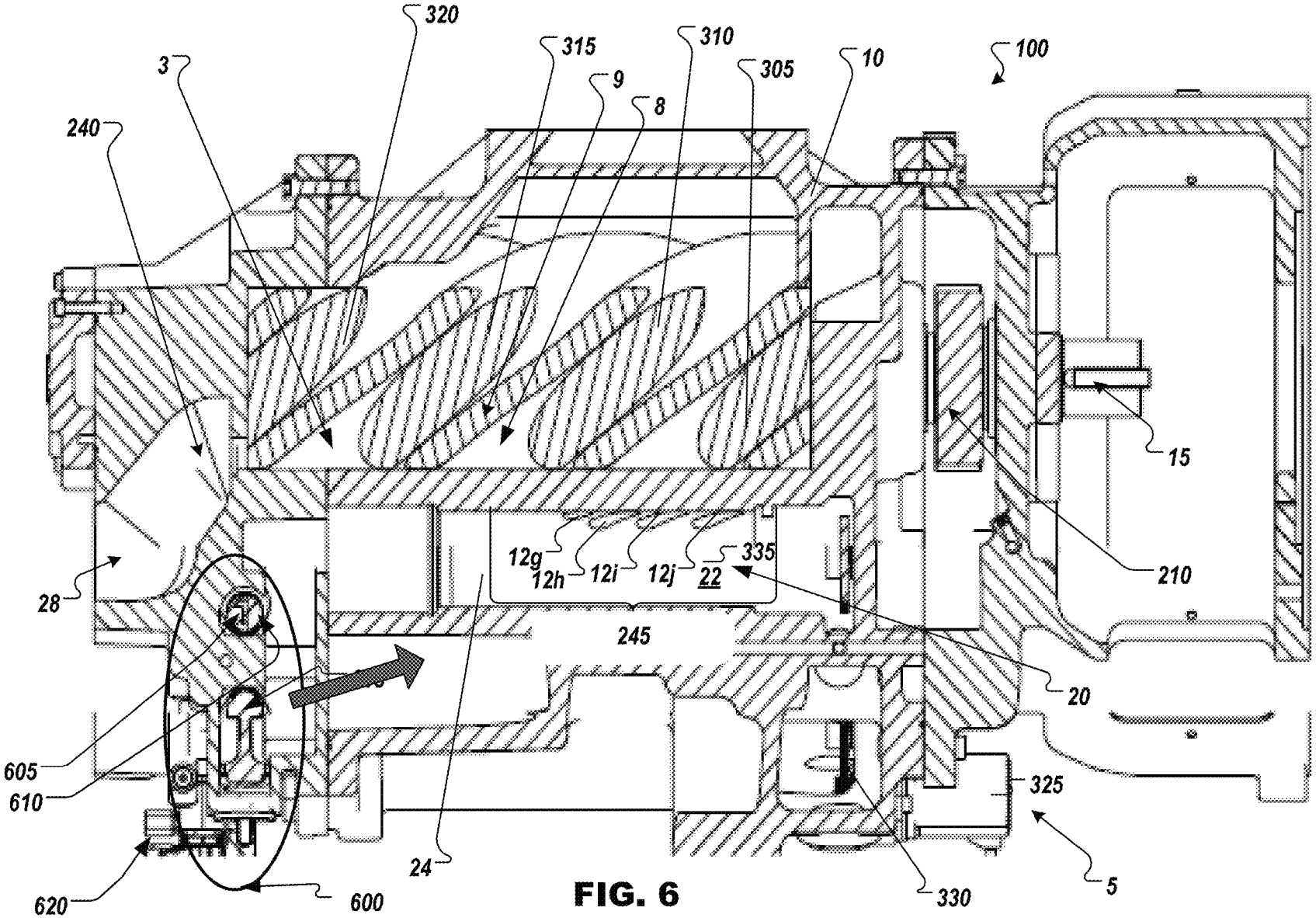
FIGS. 6-8 illustrate sectional views of the screw compressor taken along line VI-VI', line VII-VII', and line VIII-VIII' of FIG. 5, respectively.
Figure 7:
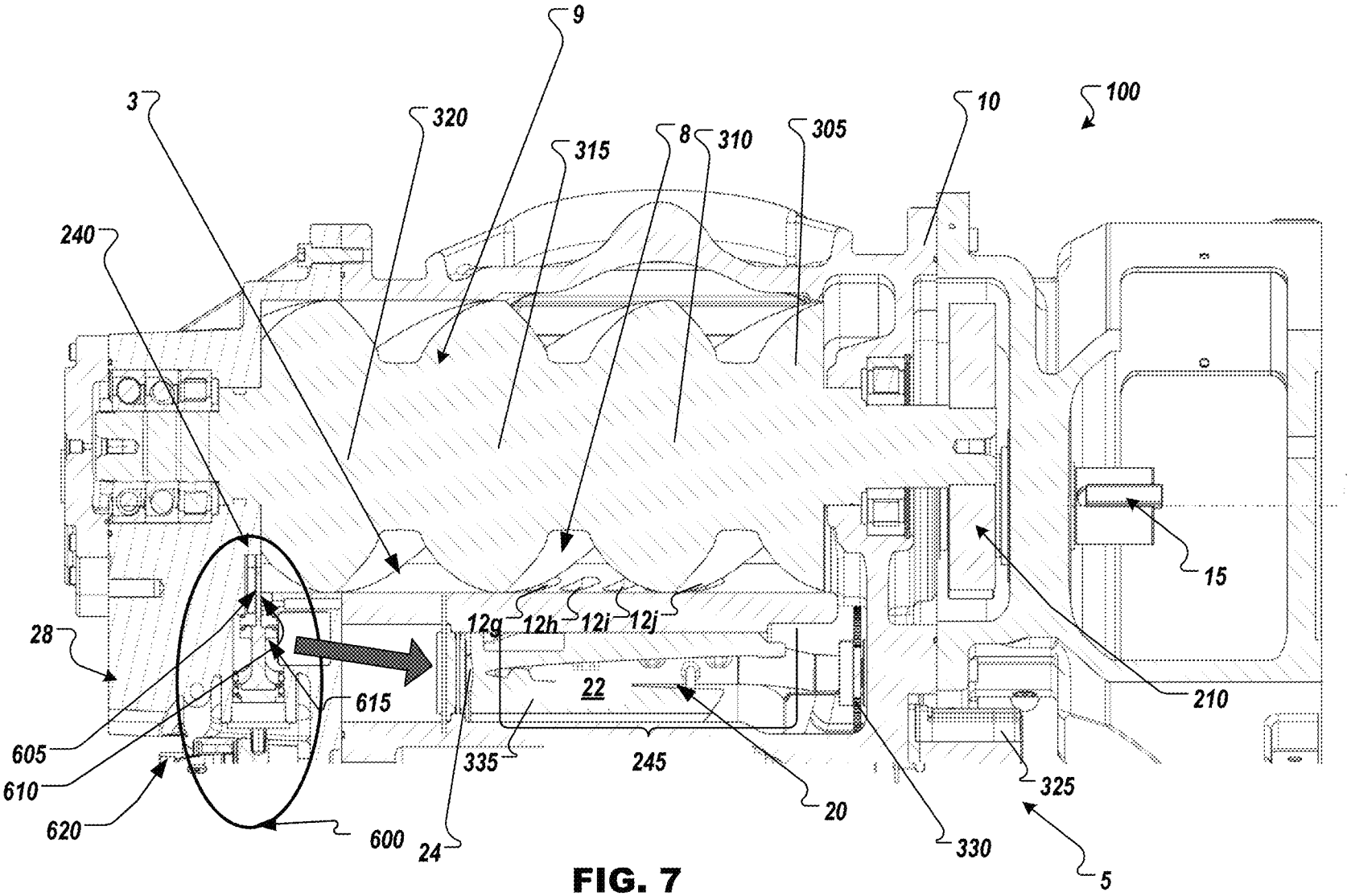
Figure 8:
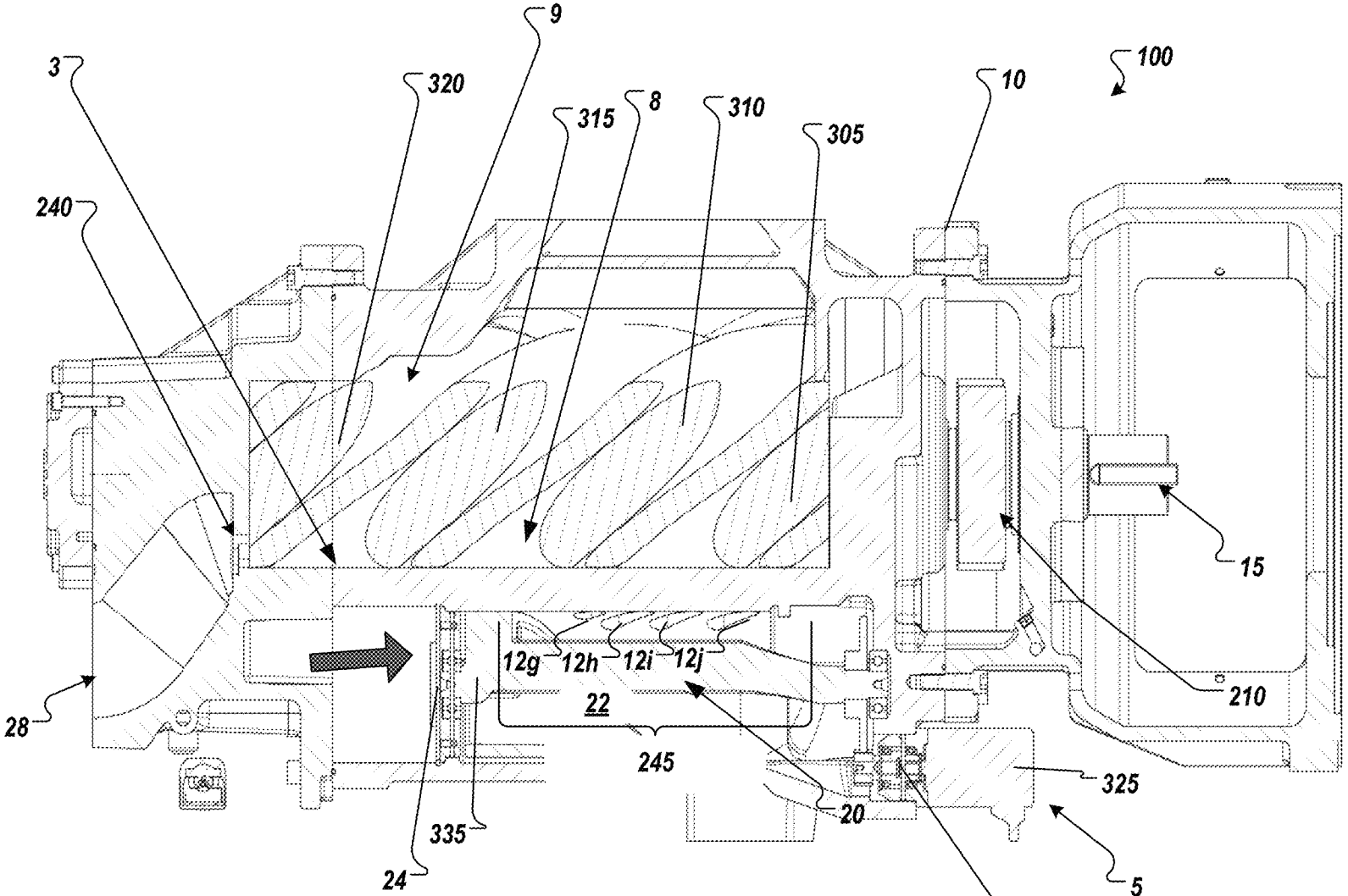

FIGS. 4-8 illustrate section views of the screw compressor. Specifically, FIGS. 4 and 5 illustrate section views of the screw compressor taken along line IV-IV' and line V-V' of FIG. 2, respectively. Further, FIGS. 6-8 illustrate section views of the screw compressor taken along line VI-VI', line VII-VII', and line VIII-VIII' of FIG. 5, respectively.

The compressor housing 10 forms a compression chamber 3 defining two adjoining bores 6 and 8, each of which includes a screw 7,9 of the twin screw gas compressor 100, when the unit is assembled and functioning. Each screw 7,9 is made up of a plurality of lobes 305/310/315/320. As illustrated, one of the screws 9 (also known as the drive screw) is mounted on the driven gear 210 and mechanically coupled to shaft 15 by drive gear 205. The motor or engine that drives the screw gas compressor is coupled to shaft 15. The other screw 7 (also known as the driven screw) is driven by drive screw 9. Both screws 7, 9 may each be supported by a bearing group 225, such as roller bearings or any other type of bearing or bushing that might be apparent to a person of ordinary skill in the art.

Further, in some example implementations, one of the screws may have a female lobe configuration, and the other of the screws may have a male lobe configuration. In other words, one of the screws may be a female compressor screw and the other screw may be a male compressor screw that interfaces with the female compressor screw. For example, the drive screw 9 may be a male compression screw and the driven screw 7 may be a female compression screw. As may be apparent to a person of ordinary skill in the art, example implementations of the present application are not limited to this configuration and some example implementations may have an alternative configuration (e.g., the drive screw 9 may be a female compression screw and the driven screw 7 may be a male compression screw).

The end of the compressor housing 10 includes an outlet 28 that fluidly communicates with the inlet 26 (shown in FIGS. 1-3). Gas flow channels 215, 220 may connect each bore 6, 8 with the inlet 26 to allow gas to flow into each bore 6, 8. Each bore 6 and 8 also comprises one or more bypass ports collectively represented by numerals 12*a*-12*j*. The illustrated bypass ports 12*a*-12*f* are formed in bore 6 associated with the driven screw 7. Further, similar bypass ports 12*g*-12*j* are formed in bore 8 associated with the drive screw 9. As shown, each bypass port 12*a*-12*j* fluidly communicates with a bypass chamber 22 that contains a spiral valve 20 that is rotatable along an axis 24. The length of each bore 6, 8 associated with the bypass ports 12*a*-12*j* may be referred to as the bypass window 245.

As described above, the compressor housing 10 has a gas inlet 26 and a gas outlet 28. Within the compressor housing, the gas flow channels 215, 220 provide fluid communication between the inlet 26 and the compression chamber 3. As the screws 7 and 9 turn within the respective bores 6, 8 of the compression chamber 3, gas is compressed inside the compression chamber 3. The compression chamber 3 has a length that runs between compression chamber inlets 230, 235 and a compression chamber outlet 240 end. The compressed gas is then output through the gas outlet 28. Arrows illustrate gas flow through the compression chamber 3.

As depicted in FIGS. 5-8, the spiral valve 20 includes a shutter 335 that selectively either blocks (close) or opens the bypass ports 12*a*-12*j*, depending on a rotational position of the spiral valve 20. As the spiral valve 20 is turned to a point that allows one or more of the bypass ports 12*a*-12*j* to fluidly communicate with the spiral valve chamber 22, the effective compression volume of the compression chamber 3 may be reduced due to the shorter compression chamber length.

For example, bypass ports 12*c*-12*e* may be opened to indicate flow and bypass ports 12*a* and 12*b* may be closed to not indicate flow. With at least one bypass port 12*c*-12*e* open, the effective compression length of the compression chamber 3 is defined by the distance between the open bypass port closest to compression chamber outlet 240 end and the compression chamber outlet 240 end itself.

When the effective compression volume is reduced in this manner, torque is reduced, which saves power, increases efficiency, and extends the life of the components of the gas compressor. However, as explained above, the efficiency of the spiral valve may be greatly reduced when the capacity is reduced greater than 50% because higher operating pressures can overcome the seal formed by oil in the gap between the spiral valve shutter 305 and the rotor housing window 245. The Variable capacity bypass valve 600 discussed below can address this deficiency.

The spiral valve 20 is coupled to an actuator module 5 that controls the rotation and position of the shutter 335 of the spiral valve 20. As illustrated, the actuator module 5 includes a motor 325 mechanically coupled to a gearbox 330. The gearbox 330 mechanically couples the motor 325 to the spiral valve 20. Thus, a torque from the motor may be transmitted to the shutter 335 of the spiral valve 20 by the gearbox 330 causing the shutter 335 to rotate. The motor 325 may be an electric actuator motor that provides precise control of rotational speed and rotational position of the spiral valve.

The actuator module 5 may be attached to the compressor housing 10 to control the spiral valve structure located within the compressor housing 10. Additionally, the actuator module 5 may also include an integrated processor component that may include onboard control logic that controls the motor 325 module automatically, semi-automatically based partially on a user input or manually based entirely on a user input.

The spiral valve 20 may be rotated (or actuated) along its axis 24 from a fully open position (where all of the bypass ports are open) to a fully closed position (where all of the bypass ports are closed), and all points in between. In FIGS. 5-8, flow is indicated as if the spiral valve 20 was rotated to a point that allowed for a partial bypass of gas from the compression chamber 3 to the bypass chamber 22. Specifically, bypass ports 12*i*-12*j* allow gas to flow from the compression chamber 3 to the bypass chamber 22.

Additionally, the screw compressor 100 may also include a Variable Capacity Bypass Valve (VCBV) 600 located near a compression chamber outlet end 240 of the compression chamber 3. The VCBV may include 1 or more bores 605 formed in discharge face 610 of the housing 10 upstream of the compression chamber outlet end 240. The one or more bores 605 may be cylindrical in shape and receives a semi-cylindrical slide valve member 615 inserted therein. Further, an actuator 620 may be positioned below the compression chamber 3 to radially articulate the valve member 615 within the bore 605 to seal and unseal the bore 605 during operation of the screw compressor 100 to open a fluid pathway connecting to the bypass chamber. The actuator 620 may be a linear actuator, rotary actuator, a stepper motor or any other actuator that may be apparent to a person of ordinary skill in the art. Moreover, the actuator 620 may be hydraulically actuated, electronically actuated, pneumatically actuated or actuated in any manner that might be apparent to a person of ordinary skill in the art.

As illustrated by FIGS. 6-8, when the VCBV 600 is opened air flows back into the bypass chamber 22 where it can be circulated back to gas flow channels 215, 220 of the compression chamber 3. The operation and implementation of the VCBV 600 is discussed in greater detail below with respect to FIGS. 9A-9D and FIGS. 10A-10B.

Figure 9B:
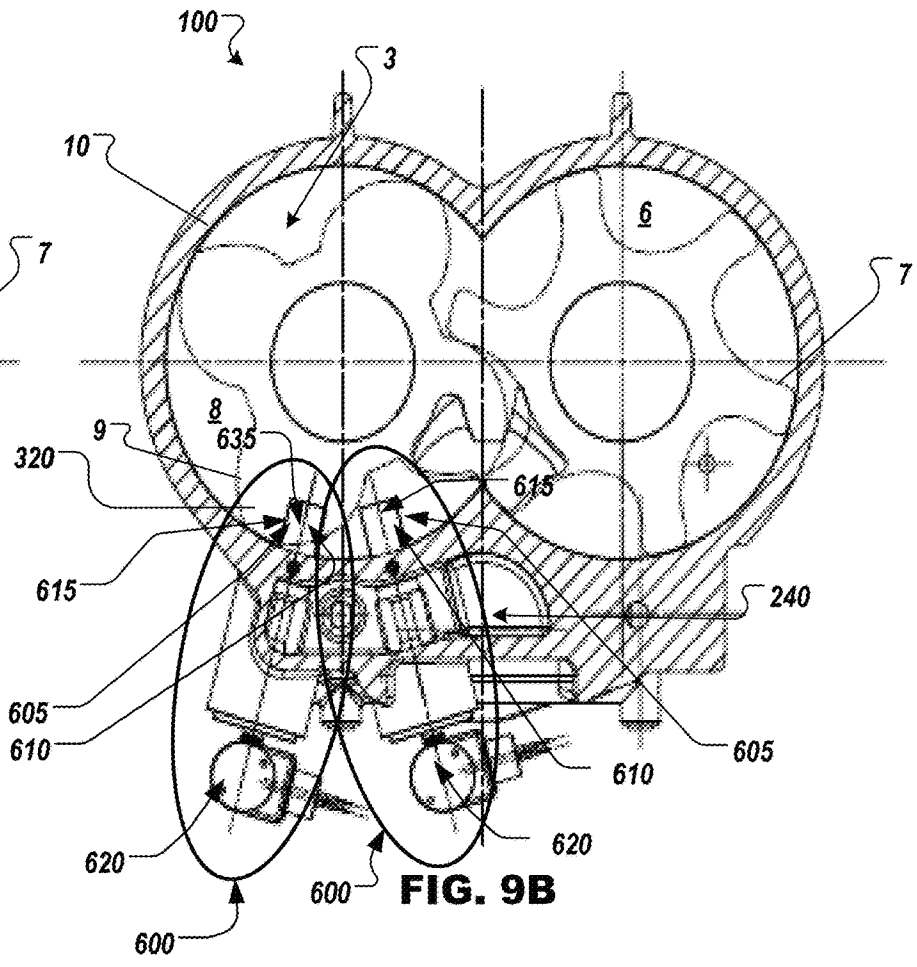
FIGS. 9A-9D are sectional views taken along line IX-IX' of FIG. 4.
Figure 9A:
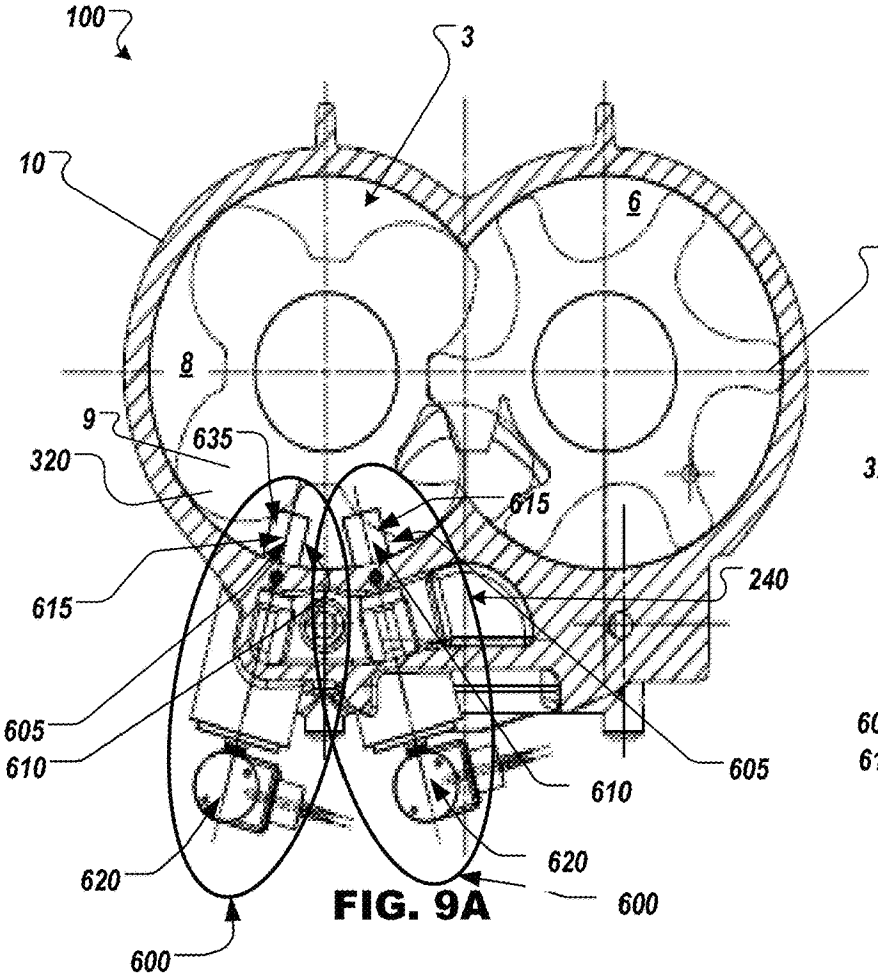
Figure 9D:
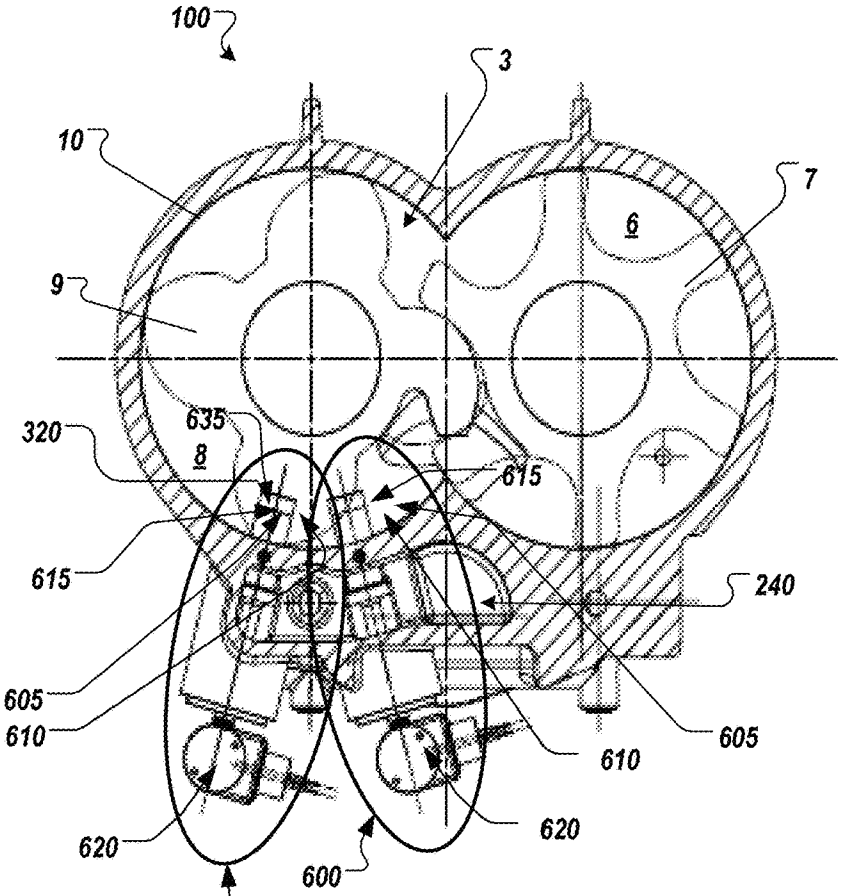
Figure 9C:
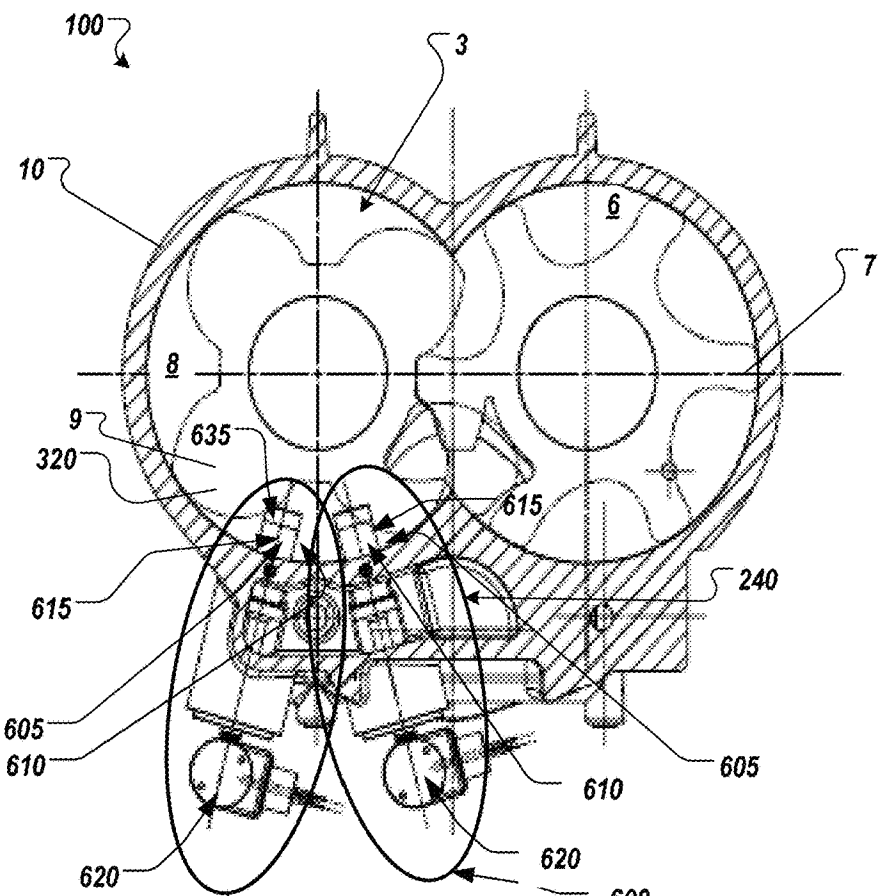
Figure 10A:
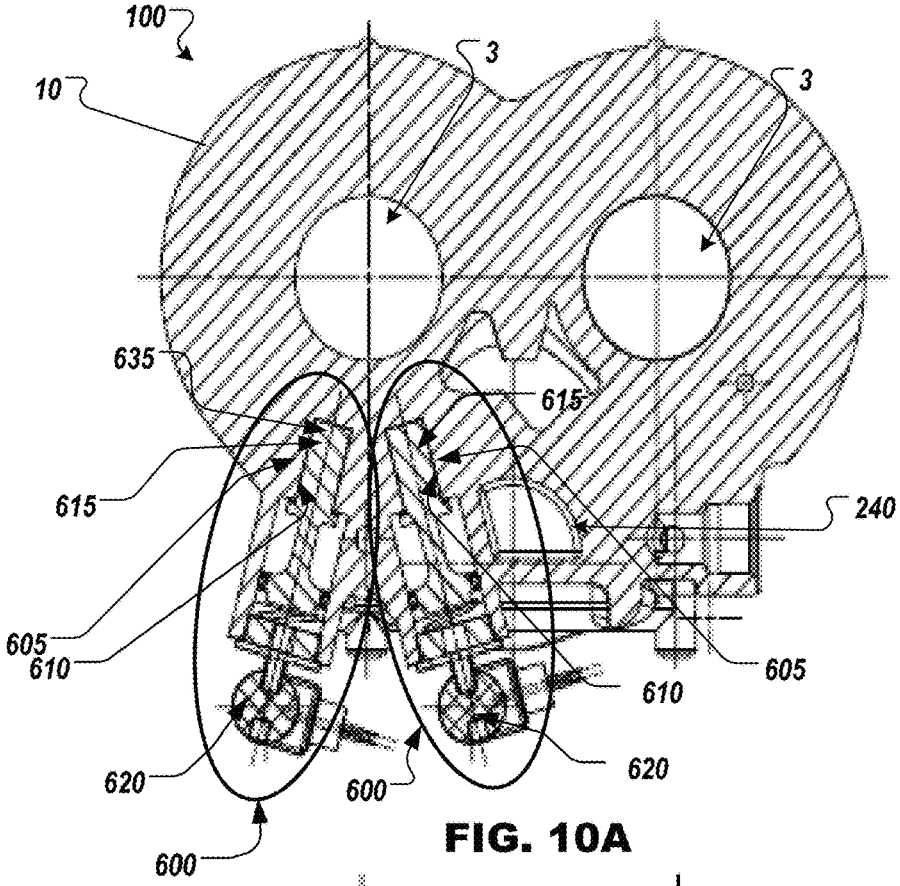
FIGS. 10A and 10B are sectional views taken along line X-X' of FIG. 4.
Figure 10B:
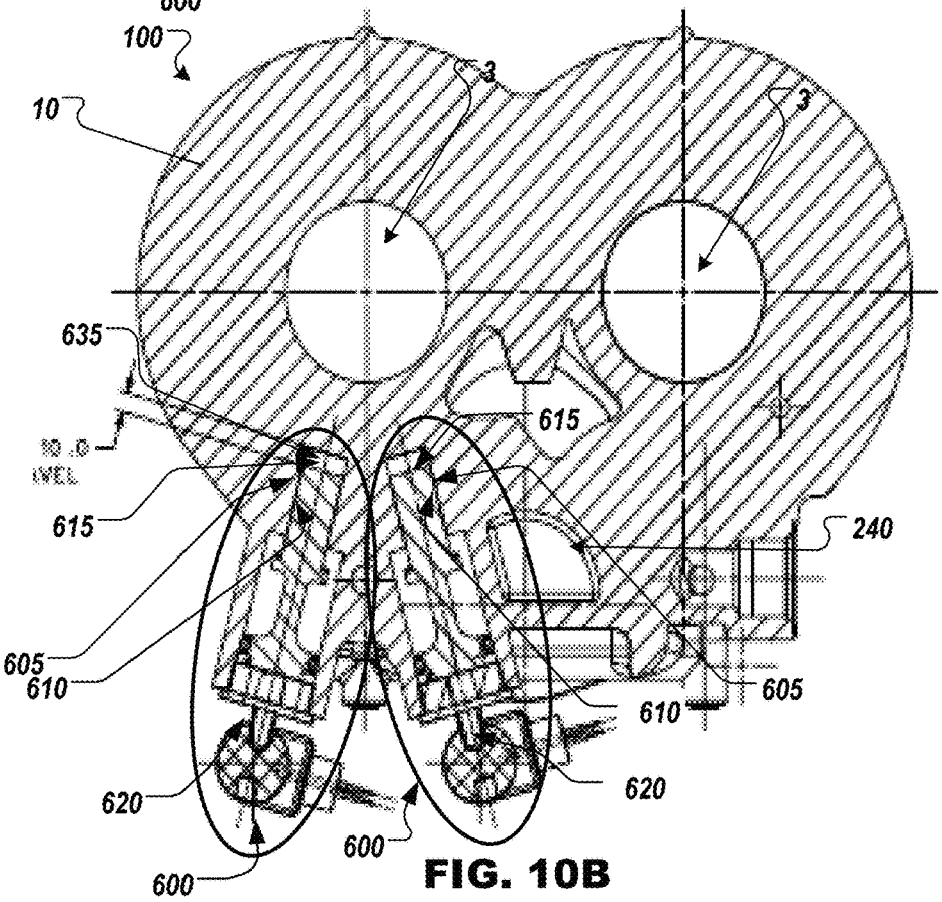

FIGS. 9A-9D and FIGS. 10A-10B illustrate sectional views of screw compressor showing various states of the Variable Capacity Bypass Valve 600 and the twin screws 7, 9. Specifically, FIGS. 9A-9B are sectional views taken along line IX-IX' of FIG. 4 with the Variable Capacity Bypass Valve 600 in a closed state as the twin screws 7, 9 rotate. Further, FIGS. 9C-9D are sectional views taken along line IX-IX' of FIG. 4 with the Variable Capacity Bypass Valve 600 in an open state as the twin screws 7, 9 rotate. Further, FIG. 10A is a sectional view taken along line X-X' of FIG. 4 with the Variable Capacity Bypass Valve 600 in a closed state. As illustrated by FIGS. 6-8, when the VCBV 600 is opened air flows back into the bypass chamber 22 where it can be circulated back to gas flow channels 215, 220 of the compression chamber 3. Additionally, FIG. 10B is a sectional view taken along line X-X' of FIG. 4 with the Variable Capacity Bypass Valve 600 in an open state.

The VCBV 600 could be implemented with one or more bores 605 provided in the male, female, or both rotor bore discharge faces 610. As illustrated, the VCBV 600 may be implemented as a plurality of bores 605 arranged circumferentially around the rotor bore discharge faces 610 of the compressor housing 10 in a rotation direction of the screws 7, 9. However, only one bore 605 on discharge face may be necessary if the valve member 615 is large enough for the desired flow and turndown. A single VCBV 600 configuration is possible because the lobes 320 of the male screw 9 and female screw 7 mesh and are connected to the same pressure cavity. Positioning the VCBV 600 on the male side only may offer benefits in that the bore 605 could be sized so its design works with the rotor design and the larger male lobes would completely cover the VCBV 600 and therefor eliminate any leakage to a lower pressure thread.

Thus, as illustrated, the bore 605 is formed in the discharge face 610 rather than in the side of the compression chamber 3 such that the lobe 320 screw 9 of the covers the bore 605 as screw rotates in the compression chamber. Further, the bore 605 has width that is less than the width of the lobe 320 of the screw 9 such that lobe 320 completely covers the bore 605 as the screw 9 rotates. This prevents fluid from back flowing around the lobe through the bore 605.

Thus, when the VCBV 600 is closed (the valve member 615 is fully extended to fill a cavity 635 formed in the rotor bore discharge face 610) as shown in FIGS. 9A, 9B, and 10A, compressed fluid remains on the high-pressure side of the lobe 320 of the screw 9 until the compression chamber outlet 240 is reached and the compressed fluid can exit the compressor outlet 28. Conversely, when the VCBV 600 is opened (the valve member 615 is retracted) as shown in FIGS. 9C, 9D, and 10B, a portion of the compressed fluid can exit the compression chamber 3 and be vented into the bypass chamber 22 where it can be circulated back to gas flow inlets 215, 220 of the compression chamber 3, instead of exiting the compression chamber outlet 240 of the compression chamber. As described in FIGS. 11 and 12, valve member 615 may have specific shape features to improve sealing efficiency.

Figure 11:
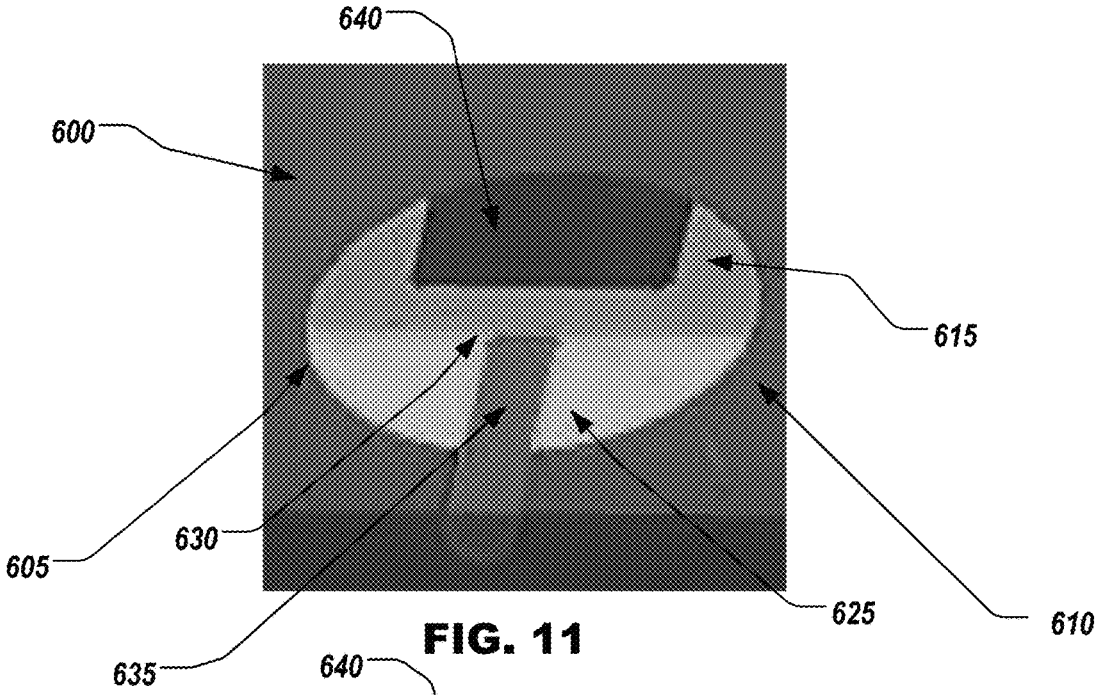
FIG. 11 illustrates a top of the Variable Capacity Bypass Valve with the valve member in a fully retracted position.
Figure 12:
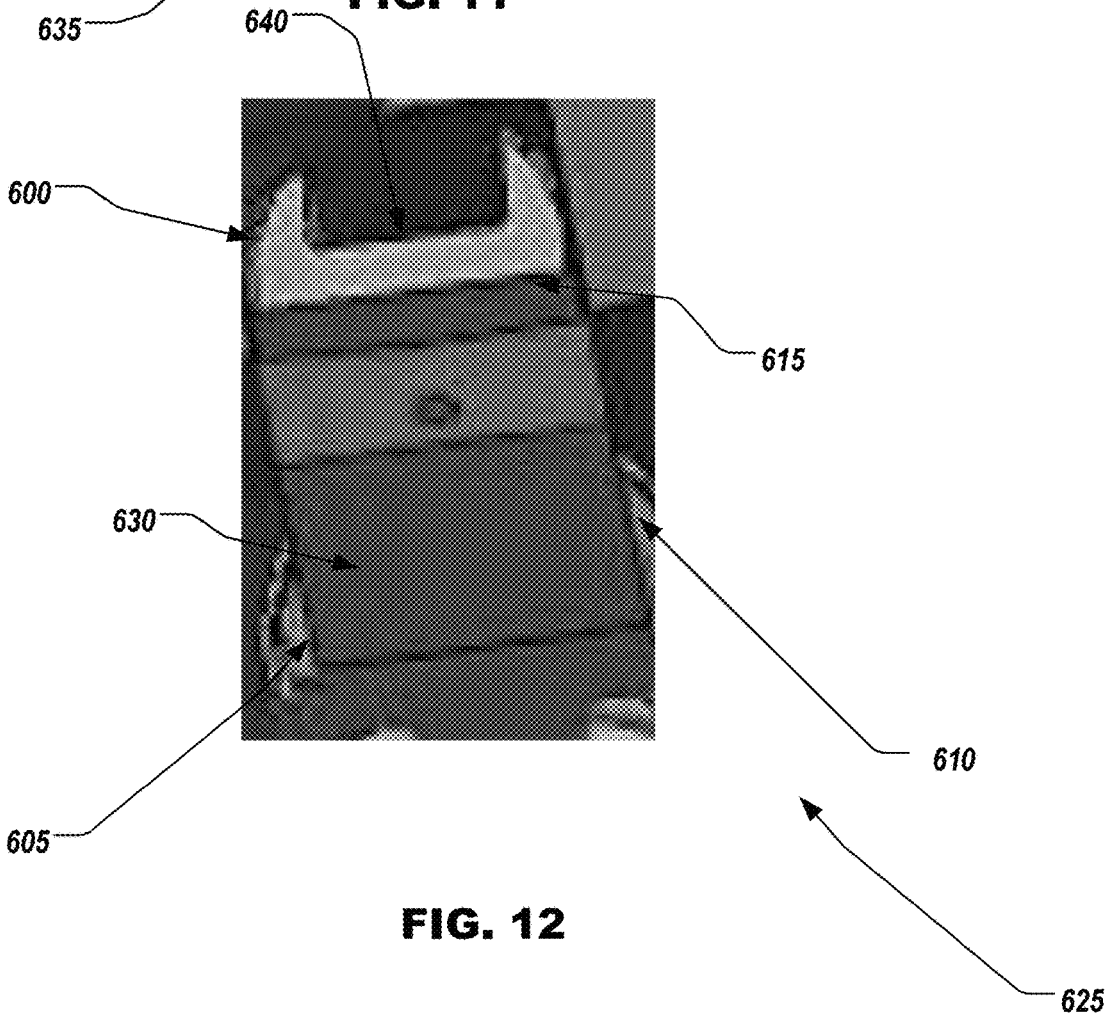
FIG. 12 illustrates a top of the Variable Capacity Bypass Valve with the valve member in a partially extended position.

FIG. 11 illustrates a top of the VCBV 600 with the valve member 615 in a fully retracted position. FIG. 12 illustrates a top of the VCBV 600 with the valve member partially extended. As illustrated, to better seal against the screw 9, the valve member 615 may be positioned against a seal 625 incorporated in the valve seat that blocks the flow path back to inlet. Further, the valve member 615 has a semi-cylindrical shape that provides a flat face 630 to interact the lobe 320 of the screw 9. The flat face 630 may be positioned to extend parallel to rotor bore discharge face. Further, the valve member 615 may be positioned or aligned off-center in the bore 605 to cause the flat face 630 to protrude outward from the rotor bore discharge face into the compression chamber 3. This allows the valve member 615 it to be positioned in the rotor bore discharge face 610 while not creating a void that would reduce compressor efficiency. This flat face 630 of the valve body's 605 moving sealing face may be easier to manufacture, assemble, and maintain than the complex moving sealing face of either lift or axial slide valves.

Further, the valve member 615 may be positioned within the bore 605 to be slightly off-centered to extend into the rotor bore. Due to the valve member 615 being partially in the rotor bore, a valve plug 625 may be provided to fill any void in the surface of the rotor bore that would cause gas leakage past the rotor apex seal to a lower pressure side of the lobe 320. The valve plug 625 is also used to maintain the valve orientation so is does not interfere with rotor movement.

Further, in some example implementations, the valve member 615 may have an opened region 640 on a side opposite the flat face 630, which forms the sealing surface to increase compressed fluid flow through the VCBV 600 when the VCBV 600 is opened. In these implementations, as the valve member 615 is lowered, compressed fluid may flow over the top of the flat face 630, into the opened region 640 and down the length of the valve member 615 and into the bypass chamber 220 as discussed above. This allows the compressed fluid to flow through the VCBV 600 while the VCBV 600 is opening in these example implementations. In other example implementations, the valve member 615 may be solid on the backside of the flat face 630.

While the invention is modifications and alternative forms, susceptible to various specific embodiments thereof have been shown by way of example in the drawings and are herein described in detail. It should be understood, however, that the description herein of specific embodiments is not intended to limit the invention to the particular forms disclosed. Moreover, example implementations are not limited to industrial or fixed location; portable configurations may be achieved by mounting the screw compressor 100 on a vehicle, trailer or other portable structure.

The foregoing detailed description has set forth various example implementations of the devices and/or processes via the use of diagrams, schematics, and examples. Insofar as such diagrams, schematics, and examples contain one or more functions and/or operations, each function and/or operation within such diagrams or examples can be implemented, individually and/or collectively, by a wide range of structures. While certain example implementations have been described, these implementations have been presented by way of example only and are not intended to limit the scope of the protection. Indeed, the novel methods and apparatuses described herein may be embodied in a variety of other forms. Furthermore, various omissions, substitutions and changes in the form of the devices and systems described herein may be made without departing from the spirit of the protection. The accompanying claims and their equivalents are intended to cover such forms or modifications as would fall within the scope and spirit of the protection.

What is claimed:

1. A variable capacity bypass valve for a screw compressor having a compressor housing defining a compression chamber, the variable capacity bypass valve comprising:

a bore formed in a rotor bore discharge face of the compressor housing upstream of a compression chamber outlet end of the compression chamber;

a slide valve member inserted into the bore to fill a cavity formed in the rotor bore discharge face of the compressor housing, the valve member having a sealing surface configured to interact with a thread of a compressor screw during operation of the screw compressor; and an actuator structure coupled to the valve member and oriented to move the valve member radially along the bore to open a fluid pathway communicatively coupling the compression chamber to a bypass chamber configured to return compressed fluid to a fluid inlet of the compression chamber, wherein the valve member has a partial cylindrical shape with an opened region on a side opposite the sealing surface in an axial direction of the screw compressor.

2. The variable capacity bypass valve of claim 1, wherein the sealing surface is a flat sealing surface extending parallel to the rotor bore discharge face of the compressor housing.

3. The variable capacity bypass valve of claim 2, wherein the valve member is aligned in the bore such that the sealing surface protrudes outward from the rotor bore discharge face into the compression chamber.

4. The variable capacity bypass valve of claim 1, wherein the sealing surface is a flat sealing surface extending parallel to the rotor bore discharge face of the compressor housing.

5. The variable capacity bypass valve of claim 4, wherein the valve member is aligned in the bore such that the sealing surface protrudes outward from the rotor bore discharge face into the compression chamber.

6. A screw compressor comprising:

a compressor housing defining a compression chamber having a compression chamber outlet end and a plurality of bypass ports communicating with the compression chamber;

a spiral valve positioned adjacent the plurality of bypass ports communicating with the compression chamber, the spiral valve comprising a shutter configured to selectively open and close one or more of the plurality of bypass ports based on a rotational position; and a variable capacity bypass valve comprising:

a bore formed in a rotor bore discharge face of the compressor housing upstream of a compression chamber outlet end of the compression chamber;

a slide valve member inserted into the bore to fill a cavity formed in the rotor bore discharge face of the compressor housing, the valve member having a sealing surface configured to interact with a thread of a compressor screw during operation of the screw compressor; and an actuator structure coupled to the valve member and oriented to move the valve member radially along the bore to open a fluid pathway communicatively coupling the compression chamber to a bypass chamber housing the spiral valve, the bypass chamber configured to return compressed fluid to a fluid inlet of the compression chamber, wherein the valve member of the variable capacity bypass valve has a partial cylindrical shape with an opened region on a side opposite the sealing surface in an axial direction of the screw compressor.

7. The screw compressor of claim 6, wherein the sealing surface of the variable capacity bypass valve is a flat sealing surface extending parallel to the rotor bore discharge face of the compressor housing.

8. The screw compressor of claim 7, wherein the valve member of the variable capacity bypass valve is aligned in the bore such that the sealing surface protrudes outward from the rotor bore discharge face into the compression chamber.

9. The screw compressor of claim 6, wherein the sealing surface of the variable capacity bypass valve is a flat sealing surface extending parallel to the rotor bore discharge face of the compressor housing.

10. The screw compressor of claim 9, wherein the valve member of the variable capacity bypass valve is aligned in the bore such that the sealing surface protrudes outward from the rotor bore discharge face into the compression chamber.

11. The screw compressor of claim 6, further comprising a plurality of variable capacity bypass valves, each variable capacity bypass valves comprising:

a bore formed in a rotor bore discharge face of the compressor housing upstream of a compression chamber outlet end of the compression chamber;

a slide valve member inserted into the bore to fill a cavity formed in the rotor bore discharge face of the compressor housing, the valve member having a sealing surface configured to interact with a thread of a compressor screw during operation of the screw compressor; and an actuator structure coupled to the valve member and oriented to move the valve member radially along the bore to open a fluid pathway communicatively coupling the compression chamber to a bypass chamber housing the spiral valve, the bypass chamber configured to return compressed fluid to a fluid inlet of the compression chamber, wherein, the bores of the plurality of variable capacity bypass valves are arranged circumferentially around the rotor bore discharge face of the compressor housing in a rotation direction of at least one screw disposed in the compression chamber.

12. The variable capacity bypass valve of claim 1, wherein the valve member has the partial cylindrical shape with the opened region on the side opposite the sealing surface to flow a compressor fluid onto the open region into a bypass region.

13. A variable capacity bypass valve for a screw compressor having a compressor housing defining a compression chamber, the variable capacity bypass valve comprising:

a bore formed in a rotor bore discharge face of the compressor housing upstream of a compression chamber outlet end of the compression chamber;

a slide valve member inserted into the bore to fill a cavity formed in the rotor bore discharge face of the compressor housing, the valve member having a sealing surface configured to interact with a thread of a compressor screw during operation of the screw compressor; and an actuator structure coupled to the valve member and oriented to move the valve member radially along the bore to open a fluid pathway communicatively coupling the compression chamber to a bypass chamber configured to return compressed fluid to a fluid inlet of the compression chamber, wherein the sealing surface is a flat sealing surface extending parallel to the rotor bore discharge face of the compressor housing, and wherein the valve member is aligned in the bore such that the sealing surface protrudes outward from the rotor bore discharge face into the compression chamber.

* * * * *